US007375608B2

(12) United States Patent
Suzuki et al.

(10) Patent No.: US 7,375,608 B2
(45) Date of Patent: May 20, 2008

(54) SOLID ELECTROLYTIC CAPACITOR AND MANUFACTURING METHOD THEREOF

(75) Inventors: Yukiharu Suzuki, Tokyo (JP); Toshihiko Kobayashi, Tokyo (JP); Toshimi Mizoguchi, Tokyo (JP)

(73) Assignee: Tamura Corporation, Tokyo (JP)

( * ) Notice: Subject to any disclaimer, the term of this patent is extended or adjusted under 35 U.S.C. 154(b) by 0 days.

(21) Appl. No.: 10/573,616

(22) PCT Filed: Sep. 29, 2003

(86) PCT No.: PCT/JP03/12430

§ 371 (c)(1),
(2), (4) Date: Sep. 18, 2006

(87) PCT Pub. No.: WO2005/031764

PCT Pub. Date: Apr. 7, 2005

(65) Prior Publication Data

US 2007/0057755 A1 Mar. 15, 2007

(51) Int. Cl.
*H01F 5/00* (2006.01)

(52) U.S. Cl. ..... 336/200; 336/223; 336/232

(58) Field of Classification Search ..... 336/200, 336/223, 232

See application file for complete search history.

(56) References Cited

U.S. PATENT DOCUMENTS 6,573,821 B2 * 6/2003 Peels et al. ..... 336/200
6,710,694 B2 * 3/2004 Matsuta et al. ..... 336/200

* cited by examiner

*Primary Examiner*—Anh T Mai

(57) ABSTRACT

The multi-layer transformer 10 of the present invention comprises a composite sheet 14*a* comprising a center magnetic pattern 11*a* and peripheral magnetic pattern 12*a* that are formed at the center and periphery respectively, and a dielectric pattern 13*a* of a nonmagnetic body that is formed in a part except the center and periphery; a composite sheet 14*b* similarly comprising a center magnetic pattern 11*b*, peripheral magnetic pattern 12*b* and a dielectric pattern 13*b*; a primary winding 15*a* that is located on one face of the dielectric pattern 13*a*; a secondary winding 15*b* that is located on one face of the dielectric pattern 13*b*; and magnetic sheets 16*a* and 16*b* that hold the composite sheets 14*a* and 14*b*, primary winding 15*a* and secondary winding 15*b* from both sides and contact one another via the center magnetic patterns 11*a* and 11*b* and peripheral magnetic patterns 12*a* and 12*b*.

14 Claims, 7 Drawing Sheets

SOLID ELECTROLYTIC CAPACITOR AND MANUFACTURING METHOD THEREOF

TECHNICAL FIELD

The present invention relates to a multi-layer magnetic part on which a coil and core are formed by stacking sheets having electromagnetic characteristics and fabrication method thereof.

BACKGROUND ART

In recent years, multi-layer transformers have attracted attention as multi-layer magnetic parts that are thin, small, and lightweight in accordance with rapid advances in the miniaturization of electronic devices. FIG. 6 is a disassembled perspective view of a stacked body of a conventional multi-layer transformer. FIG. 7 is a vertical cross-sectional view along the line VII-VII in FIG. 6 after stacking. The description below is based on FIGS. 6 and 7.

A conventional multi-layer transformer 80 comprises primary-winding magnetic sheets 82*b* and 82*d* on which primary windings 81*a* and 81*c* are formed, secondary-winding magnetic sheets 82*c* and 82*e* on which secondary windings 81*b* and 81*d* are formed, and magnetic sheets 82*a* and 82*g* that hold the magnetic sheets 82*b* to 82*e* from both sides.

Furthermore, a magnetic sheet 82*f* for improving the magnetic saturation characteristic is inserted between the magnetic sheet 82*e* and magnetic sheet 82*g*. The magnetic sheets 82*a* to 82*e* are provided with through-holes 90, 91, and 92 that connect the primary windings 81*a* and 81*c* and through-holes 93, 94, and 95 that connect the secondary windings 81*b* and 81*d*. The lower face of the magnetic sheet 82*a* is provided with primary-winding external electrodes 96 and 97 and secondary-winding external electrodes 98 and 99. The through-holes 90 to 96 are filled with a conductor. The magnetic sheets 82*a* to 82*g* are the core of the multi-layer transformer 80.

Further, FIGS. 6 and 7 are schematic diagrams and, therefore, strictly speaking, the number of windings of the primary windings 81*a* and 81*c* and secondary windings 81*b* and 81*d* and the positions of the through-holes 90 to 96 do not correspond in FIGS. 6 and 7.

On the primary side of the multi-layer transformer 80, the current flows in the order of the external electrode 96, through-hole 92, primary winding 81*c*, through-hole 91, primary winding 81*a*, through-hole 90, and then the external electrode 97 or in the reverse order. On the other hand, on the secondary side of the multi-layer transformer 80, the current flows in the order of the external electrode 99, the through-hole 95, the secondary winding 81*d*, the through-hole 94, the secondary winding 81*b*, the through-hole 93, and then the external electrode 98 or in the reverse order. The current flowing through the primary windings 81*a* and 81*c* produces a magnetic flux 100 (FIG. 7) in the magnetic sheets 82*a* to 82*g*. The magnetic flux 100 produces an electromotive force corresponding with the winding ratio in the secondary windings 81*b* and 81*d*. The multi-layer transformer 80 operates thus.

Here, supposing that the self-inductance of the primary windings 81*a* and 81*c* is L1, the self-inductance of the secondary windings 81*b* and 81*d* is L2, the mutual inductance of the primary windings 81*a* and 81*c* and the secondary windings 81*b* and 81*d* is M, and a magnetic coupling coefficient k is defined by the following equation:

$$k=|M|/\sqrt{(L1\cdot L2)}(k\leqq 1)$$

The magnetic coupling coefficient k is one of the indicators of the transformer function and the larger the magnetic coupling coefficient k, the smaller the leakage magnetic flux (leakage inductance) becomes and, therefore, the power conversion efficiency is high.

In the multi-layer transformer 80, because there is a magnetic body layer (magnetic sheets 82*c* to 82*e*) between the primary windings 81*a* and 81*c* and the secondary windings 81*b* and 81*d*, a leakage magnetic flux 101 (FIG. 7) is produced and, therefore, an adequate magnetic coupling coefficient k is not obtained. In order to resolve this problem, a technology (referred to as the 'prior art' below) that provides a dielectric layer (not shown) on the primary windings 81*a* and 81*c* and secondary windings 81*b* and 81*d* by means of screen printing or the application of paste and reduces the magnetic permeability of the magnetic body layer by means of a material that provides diffusion from the dielectric layer may be considered.

Problem to be Solved

However, the prior art is confronted by the following problems.

As a result of the diffusion of a conductive material (Ag particles, for example) from the primary windings 81*a* and 81*c* and secondary windings 81*b* and 81*d* to the conductor paste applied to the primary windings 81*a* and 81*c* and secondary windings 81*b* and 81*d*, there has been the risk of a reduction in the insulation of the primary windings 81*a*, primary windings 81*c*, secondary windings 81*b* and secondary windings 81*d*. The paste is in liquid form as a result of an organic solvent or the like, for example, and, therefore, the material is readily dispersed.

Further, even when the leakage magnetic flux is reduced by providing a dielectric layer, the gap between the primary windings 81*a* and 81*c* and secondary windings 81*b* and 81*d* widens to become 'magnetic body layer+dielectric layer'. This means that the leakage magnetic flux readily enters the gap and, therefore, acts conversely in the direction in which the magnetic coupling coefficient k is reduced. Therefore, with the prior art, it is very difficult to increase the magnetic coupling coefficient k.

OBJECT OF THE INVENTION

Accordingly, an object of the present invention is to provide a multi-layer magnetic part that makes it possible to increase the magnetic coupling coefficient while retaining the mutual insulation of the windings.

DISCLOSURE OF THE INVENTION

The multi-layer magnetic part of the present invention comprises a composite sheet the center and periphery of which are a magnetic pattern and a part of which except the center and periphery is a dielectric pattern comprising a nonmagnetic body; a primary winding that is located on one face of the dielectric pattern and around the center; a secondary winding that is located on the other face of the dielectric pattern and around the center; and a pair of magnetic sheets that hold the composite sheet and primary and secondary windings from both sides and contact one another via the magnetic pattern.

Preferably, a composite sheet may be a single sheet or a plurality of stacked sheets. Further, preferably, if the primary and secondary windings face one another with the dielectric sheet of the composite sheet interposed therebetween, the primary and secondary windings may be alternately arranged on one face of the composite sheet or the primary and secondary windings may be alternately arranged on the other face of the composite sheet. Preferably, when the composite sheet is a plurality of sheets, a plurality of the primary and secondary windings can be provided with the composite sheet interposed therebetween. Here, preferably speaking, a through-hole that connects the primary and secondary windings respectively may be provided in the composite sheet. Further, here, 'nonmagnetic body' means a material with a smaller magnetic permeability than at least a magnetic sheet. 'Dielectric sheet' means a sheet with a larger resistivity than at least a magnetic sheet and is also known as a dielectric sheet or insulation sheet.

In the case of the multi-layer magnetic part of the prior art, because there is a magnetic body layer between the primary and secondary windings, a leakage magnetic flux is produced in the magnetic body layer, whereby the magnetic coupling coefficient is reduced. Therefore, in the multi-layer magnetic part of the present invention, a nonmagnetic body layer (dielectric pattern) is first provided between the primary and secondary windings. Because a core cannot be formed by this means alone, the core is formed by making the center and periphery of the composite sheet a magnetic pattern and causing the pair of magnetic sheets to contact one another via this magnetic pattern. Therefore, in the case of the multi-layer magnetic part of the present invention, a nonmagnetic body layer (dielectric pattern) is provided between the primary and secondary windings, whereby a leakage magnetic flux can be suppressed. Moreover, unlike the prior art, there is no need to form the dielectric layer by applying a dielectric paste to the primary and secondary windings and, hence, there is no deterioration of the insulation of the primary and secondary windings and no widening of the gap between the primary and secondary windings.

Further, in a preferred embodiment, the composite sheet may be inserted between the magnetic sheet and the primary or secondary winding. This composite sheet acts to increase the insulation of the primary and secondary windings.

In a preferred embodiment, a composite sheet may have a magnetic pattern and dielectric pattern of equal film thickness. In this case, the film thickness of the composite sheet is fixed irrespective of location and the pair of magnetic sheets holding the composite sheet from both sides are also flat.

The fabrication method of the multi-layer magnetic part of the present invention is a method of fabricating the multi-layer magnetic part of the present invention. First, the magnetic sheet is created by applying a magnetic body paste to a substrate and then drying the paste. A composite sheet is created by applying a nonmagnetic body paste to a substrate in the form of the dielectric pattern, applying a magnetic-body paste in the form of the magnetic pattern and then drying the pastes. Thereafter, the primary winding and secondary winding are created by applying a conductor paste to the composite sheet or magnetic sheet and drying the paste. Thereafter, the magnetic sheet and dielectric sheet thus obtained are peeled from the substrate and stacked and pressurized to form a stacked body. Finally, this stacked body is fired.

According to the present invention, a multi-layer magnetic part in which a nonmagnetic body layer is provided between the primary and secondary windings can be implemented by forming a core by providing the dielectric pattern of the composite sheet between the primary and secondary windings, rendering the center and periphery of the composite sheet a magnetic pattern, and then causing the pair of magnetic sheets to contact one another via the magnetic pattern, whereby a leakage magnetic flux can be suppressed. Moreover, unlike the prior art, there is no need to form a dielectric layer by applying dielectric paste to the primary and secondary windings and, therefore, there is no deterioration of the insulation of the primary and secondary windings and no widening of the gap between the primary and secondary windings. Therefore, the magnetic coupling coefficient can be increased while retaining the mutual insulation of the windings. Furthermore, by inserting a dielectric pattern instead of a conventional magnetic sheet, the insulation of the primary and secondary windings can also be increased.

In addition, because both the dielectric pattern and the magnetic pattern are formed in one composite sheet, in comparison with a case where the same structure is formed by stacking a dielectric sheet comprising a stacked body alone and a magnetic sheet comprising a magnetic body alone, the number of sheets can be reduced and the stacking method can be simplified.

Furthermore, the primary and secondary windings can be electrically protected by inserting a composite sheet that is the same as that described above between the magnetic sheet and the primary or secondary winding, whereby the insulation can be improved.

By providing a through-hole that connects the primary windings and secondary windings respectively in the composite sheet, the primary and secondary windings can be connected simply in comparison with a case where same are connected by means of leads or the like, whereby fabrication can be facilitated.

Because the film thicknesses of the magnetic sheet and dielectric sheet are equal, the film thickness of the composite sheet is fixed irrespective of location and, therefore, the pair of magnetic sheets holding the composite sheet from both sides can be made flat. Therefore, a wiring pattern or the like can be accurately formed on the magnetic sheet.

BEST MODE FOR CARRYING OUT THE INVENTION

Figure 1:
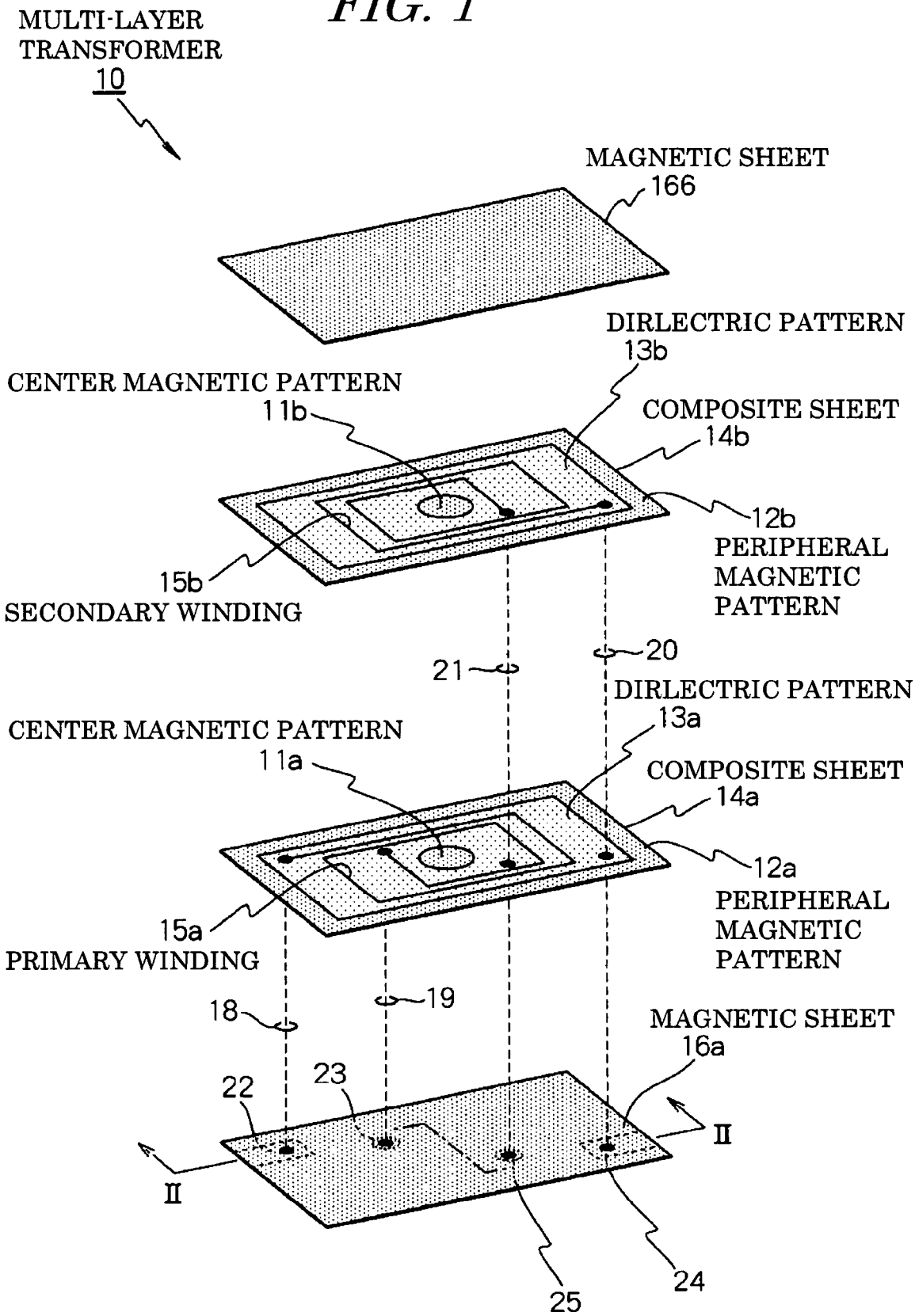
FIG. 1 is a disassembled perspective view of a first embodiment of the multi-layer transformer according to the present invention.
Figure 2:
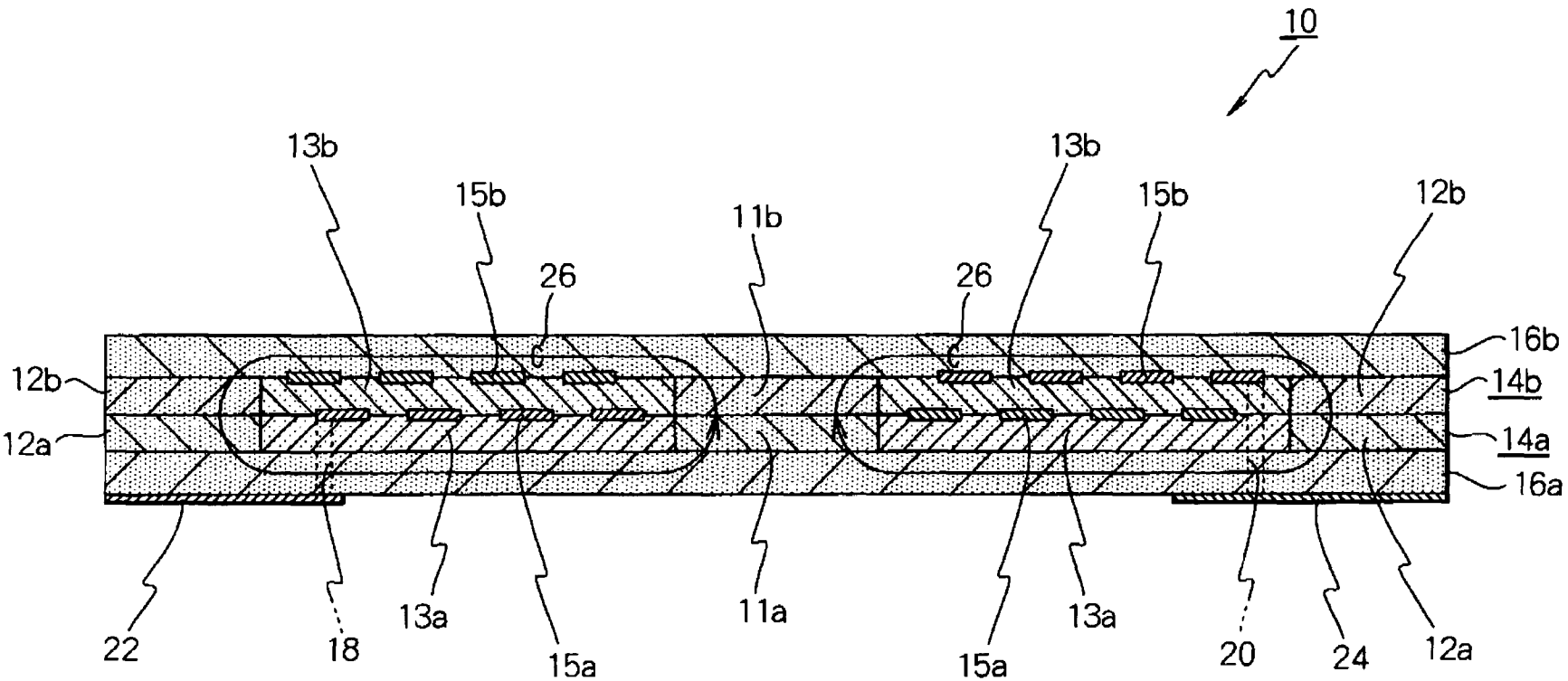
FIG. 2 is a vertical cross-sectional view along the line II-II in FIG. 1 after stacking.

An embodiment of the multi-layer magnetic part of the present invention will be described in specific terms by taking the example of a multi-layer transformer. FIG. 1 is a disassembled perspective view of a multi-layer transformer according to a first embodiment (corresponding with claim 1) of the present invention. FIG. 2 is a vertical cross-sectional view along the line II-II in FIG. 1 after stacking.

The description below is based on these figures.

A multi-layer transformer 10 of this embodiment comprises a composite sheet 14*a* comprising a center magnetic pattern 11*a* and peripheral magnetic pattern 12*a* that are formed at the center and periphery respectively and a dielectric pattern 13*a* of a nonmagnetic body that is formed in a part except the center and periphery; a composite sheet 14*b* comprising a center magnetic pattern 11*b* and peripheral magnetic pattern 12*b* that are formed at the center and periphery respectively, and a dielectric pattern 13*b* of a nonmagnetic body that is formed in a part except the center and periphery; a primary winding 15*a* that is located on one face of the dielectric pattern 13*a* and around the center; a secondary winding 15*b* that is located on one face of the dielectric pattern 13*b* and around the center; and a pair of magnetic sheets 16*a* and 16*b* that hold the composite sheets 14*a* and 14*b*, primary winding 15*a* and secondary winding 15*b* from both sides and contact one another via the center magnetic patterns 11*a* and 11*b* and peripheral magnetic patterns 12*a* and 12*b*. That is, this can be put another way by saying that the primary winding 15*a* is located on the other face of the dielectric pattern 13*b* and the secondary winding 15*b* is located on one face of the dielectric pattern 13*b*.

Further, through-holes 18 and 19 that connect the primary winding 15*a* and through-holes 20 and 21 that connect the secondary winding 15*b* are provided in the composite sheets 14*a* and 14*b* and magnetic sheet 16*a*. Primary-winding external electrodes 22 and 23 and secondary-winding external electrodes 24 and 25 are provided in the lower face of the magnetic sheet 16*a*. The through-holes 18 to 21 are filled with a conductor. The center magnetic patterns 11*a* and 11*b*, peripheral magnetic patterns 12*a* and 12*b*, and magnetic sheets 16 and 17 constitute the core of the multi-layer transformer 10.

Further, FIGS. 1 and 2 are schematic diagrams and, therefore, strictly speaking, the number of windings of the primary winding 15*a* and secondary winding 15*b* and the positions of the through-holes 18 to 21 do not correspond in FIGS. 1 and 2. Furthermore, in FIG. 2, the film thickness direction (vertical direction) is shown enlarged more than the width direction (lateral direction).

On the primary side of the multi-layer transformer 10, current flows in the order of the external electrode 22, through-hole 18, primary winding 15*a*, through-hole 19, and then external electrode 23, or in the reverse order. On the other hand, on the secondary side of the multi-layer transformer 10, current flows in the order of the external electrode 24, through-hole 20, secondary winding 15*b*, through-hole 21, and then external electrode 25, or in the reverse order. The current that flows through the primary winding 15*a* produces a magnetic flux 26 (FIG. 2) in the magnetic sheets 16*a* and 16*b*. The magnetic flux 26 produces an electromotive force corresponding with the winding ratio in the secondary winding 15*b*. The multi-layer transformer 10 operates thus.

In the multi-layer transformer 10, because there is a nonmagnetic body layer (dielectric pattern 13*b*) between the primary winding 15*a* and secondary winding 15*b*, a leakage magnetic flux can be suppressed. Moreover, unlike the prior art, because there is no need to form a dielectric layer by applying a dielectric paste to the primary winding 15*a* and secondary winding 15*b*, there is no deterioration of the insulation of the primary windings 15*a* and secondary windings 15*b* and no widening of the gap between the primary winding 15*a* and secondary winding 15*b*. Therefore, the magnetic coupling coefficient k can be increased while retaining the mutual insulation of the windings. Furthermore, by inserting the dielectric pattern 13*b*, the insulation of the primary winding 15*a* and secondary winding 15*b* also increases.

In the case of the composite sheet 14*a*, the film thickness of the center magnetic pattern 11*a* and peripheral magnetic pattern 12*a* and the film thickness of the dielectric pattern 13*b* are equal. The composite sheet 14*b* is also the same. As a result, the film thickness of the composite sheets 14*a* and 14*b* is the same irrespective of location and, therefore, the pair of magnetic sheets 16*a* and 16*b* that hold the composite sheets 14*a* and 14*b* from both sides are also flat.

Further, it is also possible to omit the composite sheet 14*a* by forming a primary winding 15*a* and secondary winding 15*b* respectively on the two faces of the composite sheet 14*b*. The secondary winding 15*b* is not on the composite sheet 14*b* but may be formed on the magnetic sheet 16*b*. A composite sheet that increases the insulation of the secondary winding 15*b* may be inserted between the secondary winding 15*b* and magnetic sheet 16*b*. Further, the materials and dimensions of each of the constituent elements and the overall fabrication method and so forth are pursuant to the second embodiment described subsequently.

Figure 3:
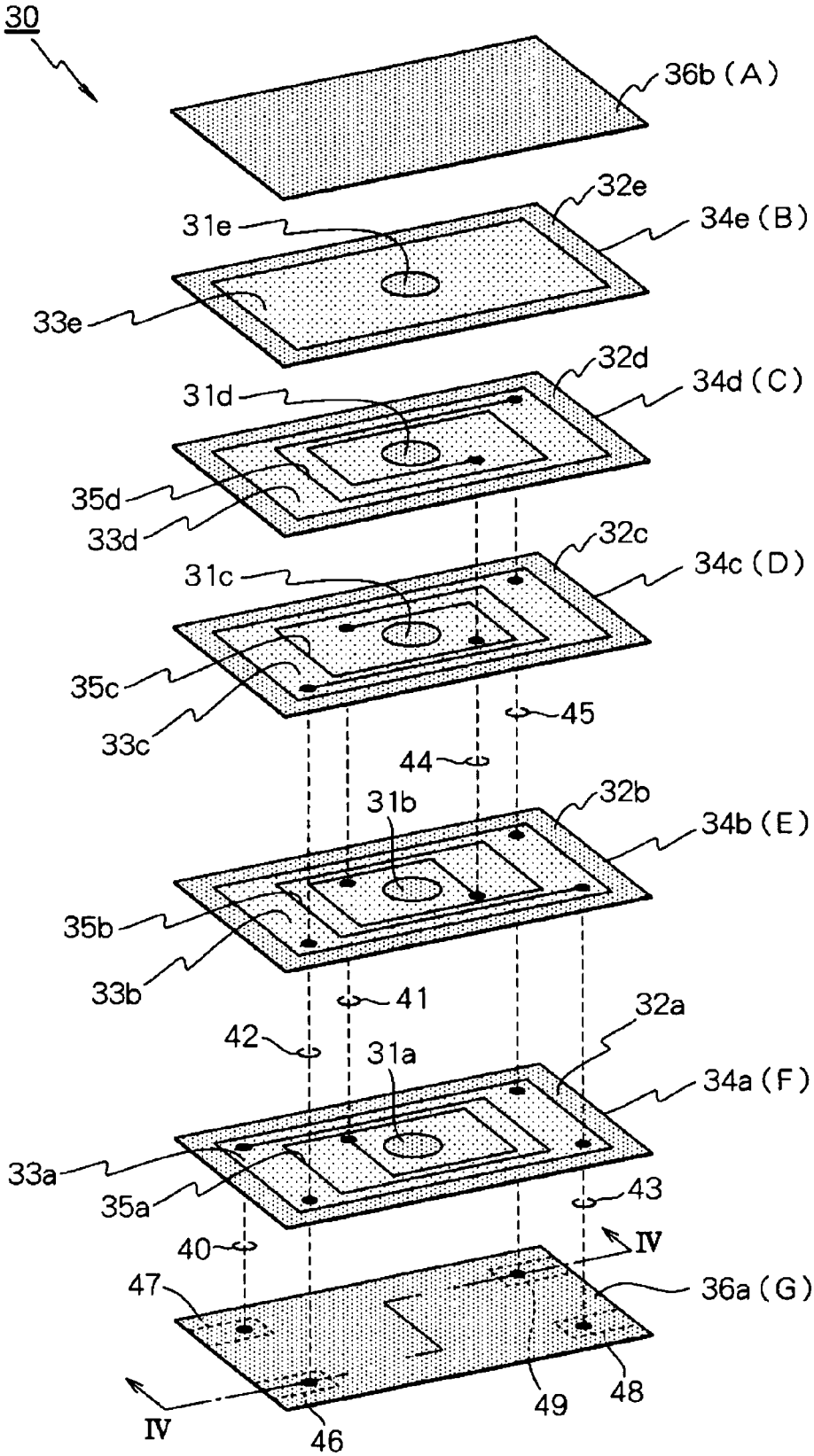
FIG. 3 is a disassembled perspective view of a second embodiment of the multi-layer transformer according to the present invention.
Figure 4:
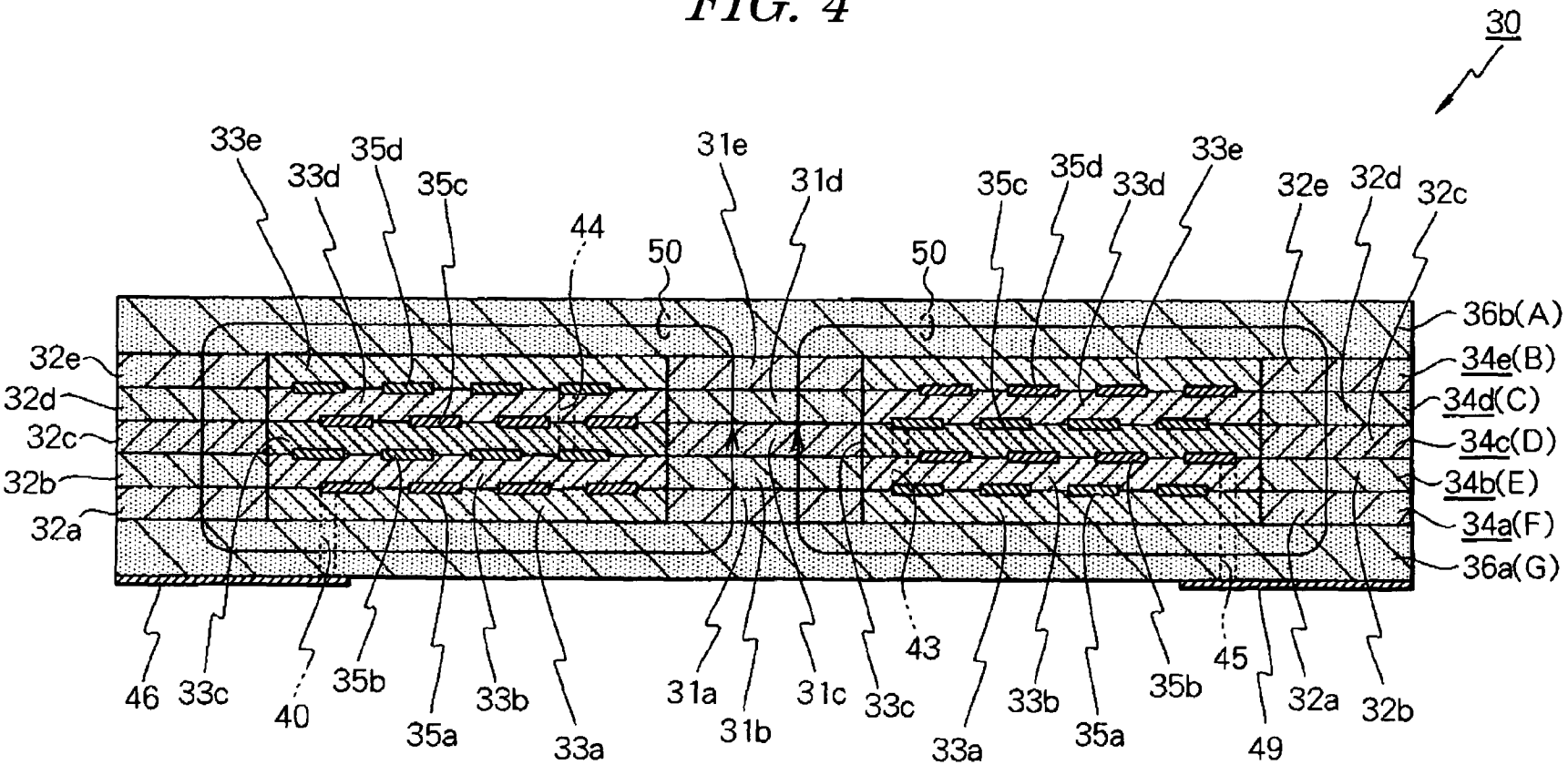
FIG. 4 is a vertical cross-sectional view along the line IV-IV in FIG. 3 after stacking.

FIG. 3 is a disassembled perspective view of the second embodiment of the multi-layer transformer according to the present invention. FIG. 4 is a vertical cross-sectional view along the line IV-IV in FIG. 3 after stacking. The following description is based on these figures.

The multi-layer transformer 30 of this embodiment comprises a primary-winding formation composite sheet 34*a* comprising a center magnetic pattern 31*a* and peripheral magnetic pattern 32*a* formed at the center and periphery thereof respectively and a dielectric pattern 33*a* of a nonmagnetic body formed in a part except the center and periphery; a secondary-winding formation composite sheet 34*b* comprising a center magnetic pattern 31*b* and peripheral magnetic pattern 32*b* formed at the center and periphery thereof respectively and a dielectric pattern 33*b* of a nonmagnetic body formed in a part except the center and periphery; a primary-winding formation composite sheet 34*c* comprising a center magnetic pattern 31*c* and peripheral magnetic pattern 32*c* formed at the center and periphery thereof respectively and a dielectric pattern 33*c* of a nonmagnetic body formed in a part except the center and periphery; a secondary-winding formation composite sheet 34*d* comprising a center magnetic pattern 31*d* and peripheral magnetic pattern 32*d* formed at the center and periphery thereof respectively and a dielectric pattern 33*d* of a nonmagnetic body formed in a part except the center and periphery; a secondary-winding protection composite sheet 34*e* comprising a center magnetic pattern 31*e* and peripheral magnetic pattern 32*e* formed at the center and periphery thereof respectively and a dielectric pattern 33*e* of a nonmagnetic body formed in the center other than the center and periphery; a primary winding 35*a* that is located on one face of the dielectric pattern 33*a* and around the center; a secondary winding 35*b* that is located on one face of the dielectric pattern 33*b* and around the center; a primary winding 35*c* that is located on one face of the dielectric pattern 33*c* and around the center; a secondary winding 35*d* that is located on one face of the dielectric pattern 33*d* and around the center; and a pair of magnetic sheets 36*a* and 36*b* that hold the composite sheets 34*a* to 34*e*, primary windings 35*a* and 35*c*, and secondary windings 35*b* and 35*d* from both sides and contact one another via center magnetic patterns 31*a* to 31*e* and peripheral magnetic patterns 32*a* to 32*e*.

That is, this can also be stated by saying that the primary winding 35*a* is located on the other face of the dielectric pattern 33*b*, the secondary winding 35*b* is located on one face of the dielectric pattern 33*b*, the secondary winding 35*b* is located on the other face of the dielectric pattern 33*c*, the primary winding 35*c* is located on one face of the dielectric pattern 33*c*, the primary winding 35*c* is located on the other face of the dielectric pattern 33*d*, and the secondary winding 35*d* is located on one face of the dielectric pattern 33*d*.

Through-holes 40, 41, and 42 that connect the primary windings 35*a* and 35*c* are provided in the composite sheets 34*a* to 34*c* and magnetic sheet 36*a*. Through-holes 43, 44, 45 that connect secondary windings 35*b* and 35*d* are provided in the composite sheets 34*a* to 34*d* and the magnetic sheet 36*a*. Primary-winding external electrodes 46 and 47 and secondary-winding external electrodes 48 and 49 are provided on the lower face of the magnetic sheet 36*a*. Through-holes 40 to 45 are filled with a conductor. Center magnetic patterns 31*a* to 31*e*, peripheral magnetic patterns 32*a* to 32*e* and magnetic sheets 36*a* and 36*b* constitute the core of the multi-layer transformer 30.

Further, because FIGS. 3 and 4 are schematic diagrams, strictly speaking, the number of windings of the primary windings 35*a* and 35*c* and secondary windings 35*b* and 35*d* and the positions of the through-holes 40 to 45 and so forth do not correspond in FIGS. 3 and 4. Further, in FIG. 4, the film thickness direction (vertical direction) is shown enlarged more than the width direction (lateral direction).

The actual dimensions of each of the constituent elements are illustrated. The magnetic sheets 36*a* and 36*b* have a film thickness of 100 μm, a width of 8 mm and a depth of 6 mm. The dielectric sheets 34*a* to 34*e* have a film thickness of 50 μm, a width of 8 mm and 6 mm deep. The primary windings 35*a* and 35*c* and secondary windings 35*b* and 35*d* have a film thickness of 15 μm, and a line width of 200 μm. A number of stacked sheets of about 10 to 50 is practical.

On the primary side of the multi-layer transformer 30, the current flows in the order of the external electrode 46, through-hole 42, primary winding 35*c*, through-hole 41, primary winding 35*a*, through-hole 40, and then the external electrode 47, or in the reverse order. On the other hand, on the secondary side of the multi-layer transformer 30, the current flows in the order of the external electrode 49, through-hole 45, secondary winding 35*d*, through-hole 44, secondary winding 35*b*, through-hole 43, and then the external electrode 48, or in the reverse order. The current that flows through the primary windings 35*a* and 35*c* produces a magnetic flux 50 (FIG. 4) in the center magnetic patterns 31*a* to 31*e*, the peripheral magnetic patterns 32*a* to 32*e* and the magnetic sheets 36*a* and 36*b*. The magnetic flux 50 produces an electromotive force corresponding with the winding ratio in the secondary windings 35*b* and 35*d*. The multi-layer transformer 30 operates thus.

In the multi-layer transformer 30, because there is a nonmagnetic body layer (dielectric patterns 33*b* to 33*d*) between the primary windings 35*a* and 35*c* and secondary windings 35*b* and 35*d*, a leakage magnetic flux can be suppressed. Moreover, unlike the prior art, there is no need to form a dielectric layer by applying a dielectric paste on the primary windings 35*a* and 35*c* and secondary windings 35*b* and 35*d* and, therefore, there is no deterioration of the insulation of the primary windings 35*a*, primary windings 35*c*, secondary windings 35*b* and secondary windings 35*d* and no widening of the gap between the primary windings 35*a* and 35*c* and secondary windings 35*b* and 35*d*. Therefore, the magnetic coupling coefficient k can be increased while retaining the mutual insulation of the windings. In addition, the insulation of the primary windings 35*a* and 35*c* and secondary windings 35*b* and 35*d* also increases as a result of the insertion of the dielectric patterns 34*b* to 34*d*.

In the case of the composite sheet 34*a*, the film thickness of the center magnetic pattern 31*a* and peripheral magnetic pattern 32*a* and the film thickness of the dielectric pattern 33*a* are equal. The composite sheets 34*b* to 34*e* are also the same. As a result, the film thickness of the composite sheets 34*a* and 34*e* is the same irrespective of location and, therefore, the pair of magnetic sheets 36*a* and 36*b* that hold the composite sheets 34*a* to 34*e* from both sides are also flat.

Figure 5:
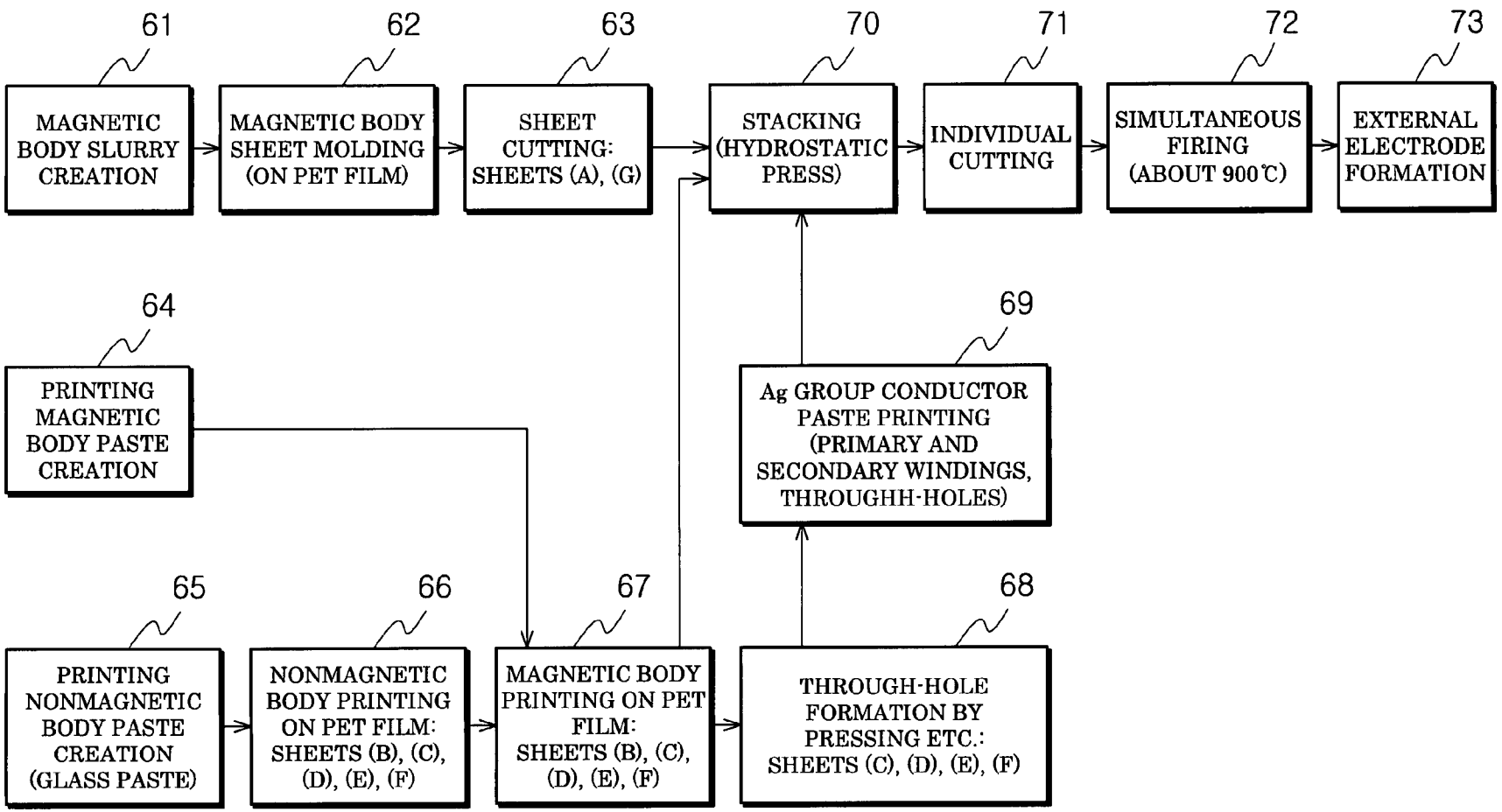
FIG. 5 is a process diagram of a fabrication method of the multi-layer transformer in FIG. 3.
Figure 6:
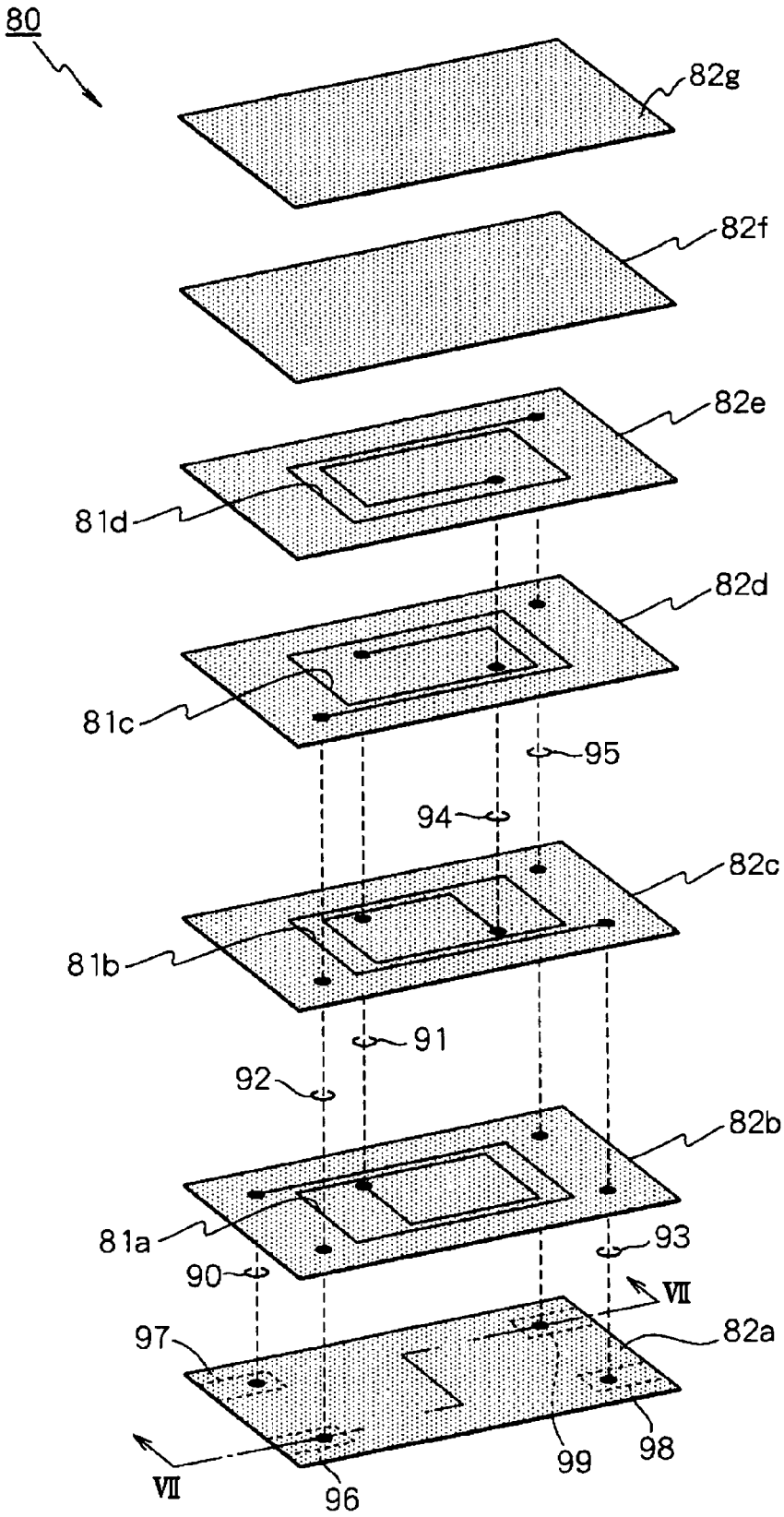
FIG. 6 is a disassembled perspective view of a conventional multi-layer transformer.
Figure 7:
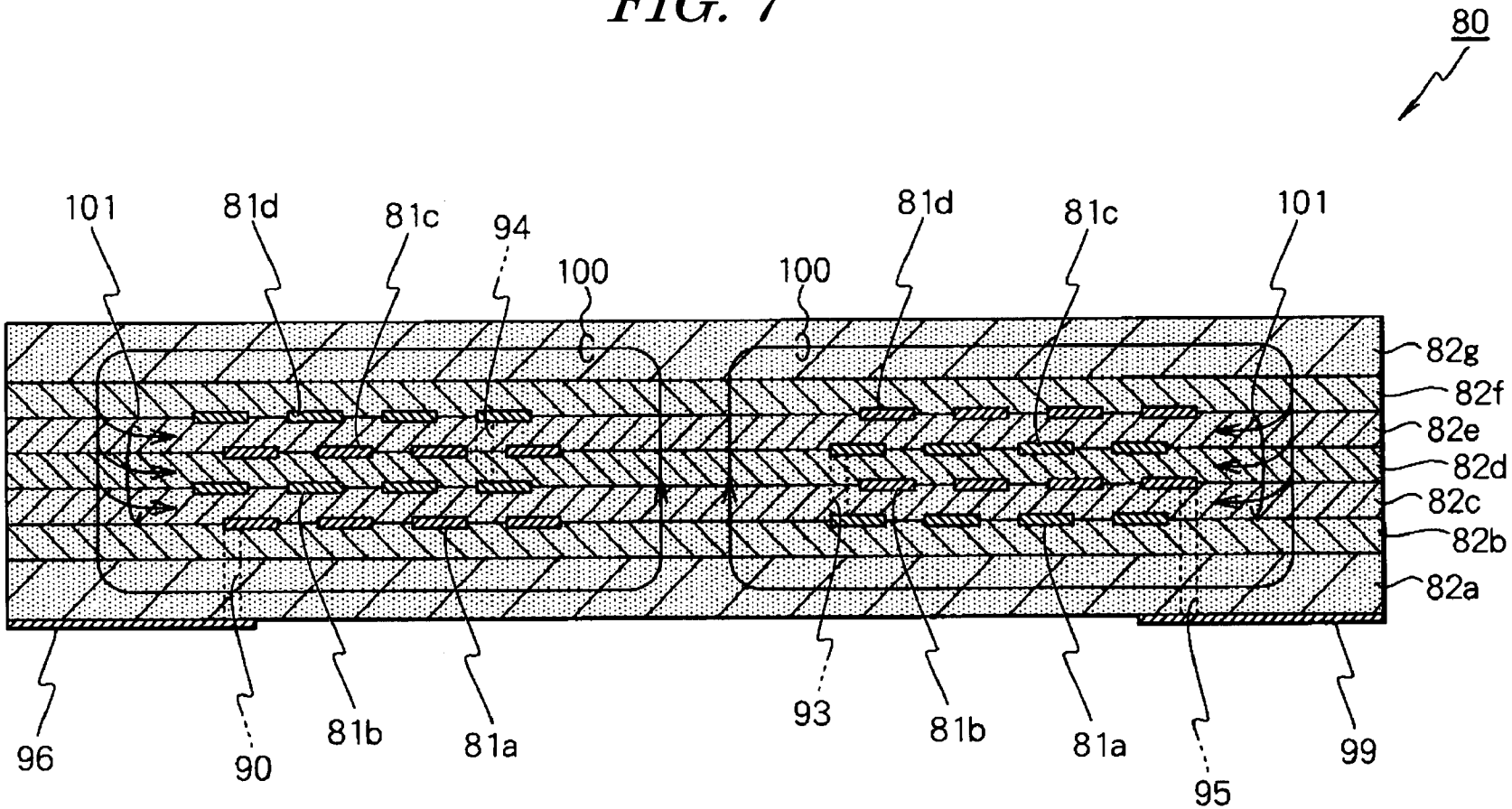
FIG. 7 is a vertical cross-sectional view along the line VII-VII in FIG. 6 after stacking.

FIG. 5 shows a process diagram of a fabrication method (corresponding with claim 5) of the multi-layer transformer in FIG. 3. The following description is based on these figures.

The composite sheets (B), (C), (D), (E), and (F) in FIG. 5 correspond with composite sheets 34*e*, 34*d*, 34*c*, 34*b*, and 34*a* in FIG. 3. The magnetic sheets (A) and (G) in FIG. 5 correspond with magnetic sheets 36*b* and 36*a* in FIG. 3.

First, a magnetic body slurry is created (process 61). The magnetic material is a Ni—Cu—Zn group, for example. Subsequently, a magnetic sheet is molded by placing a magnetic body slurry on a PET (polyethylene terephthalate) film by using the doctor blade method (process 62). Thereafter, by cutting the magnetic sheet, the magnetic-flux formation magnetic sheets (A) and (G) are obtained (process 63).

A magnetic body paste (an Ni—Cu—Zn group, for example) is created (process 64) and a nonmagnetic body paste (glass paste, for example) is separately created (process 65). Thereafter, the dielectric patterns of the composite sheets (B), (C), (D), (E), and (F) are created by placing a nonmagnetic body paste on a PET film by using the screen-printing method (process 66). Subsequently, the magnetic patterns of the composite sheets (B), (C), (D), (E), and (F) are created by placing a magnetic body paste on a PET film by using the screen-printing method (process 67). Subsequently, through-holes are formed by means of a press or the like in the composite sheets (C), (D), (E), and (F) (process 68) and the primary and secondary windings are formed by screen-printing an Ag-group conductive paste and the through-holes are filled with a conductor (process 69).

Thereafter, the magnetic sheets (A) and (G) obtained in process 63, composite sheet (B) obtained in process 67, and composite sheets (C), (D), (E), and (F) obtained in process 69 are peeled from the PET film and stacked and made to adhere by using a hydrostatic press or the like to produce a stacked body (process 70). Subsequently, the stacked body is cut to a predetermined size (process 71). Simultaneous firing at about 900° C. is then executed (process 72). Finally, the multi-layer transformer is completed by forming an external electrode (process 73).

Further, it is understood that the present invention is not limited to the above embodiment. For example, there may be any number of composite sheets and primary and secondary windings. The shape of the primary and secondary windings is not limited to a helical shape and may be rendered by overlapping a multiplicity of letter-L shapes.

EMBODIMENT

Here, the results of measurement of the electrical characteristics of the multi-layer transformer of the prior art and the multi-layer transformer of the present invention are shown in a comparison. The constitution of the multi-layer transformer of the prior art and of this embodiment used as this example is provided below.

(1) Transformer of the Prior Art
Primary winding: five turns/layer one layer: five turns
Secondary winding: five turns/layer two layers: ten turns
Magnetic body; use initial magnetic permeability 100

(2)-1 New Structure Multi-Layer Transformer 10
Primary winding: five turns/layer one layer: five turns
Secondary winding: five turns/layer two layers: ten turns
Magnetic body; use initial magnetic permeability 100

(2)-2 New Structure Multi-Layer Transformer 10
Primary winding: five turns/layer one layer: five turns
Secondary winding: five turns/layer two layers: ten turns
Magnetic body; use initial magnetic permeability 500

(3)-1 New Structure Multi-Layer Transformer 30
Primary winding: five turns/layer three layers: fifteen turns
Secondary winding: five turns/layer six layers: thirty turns
Magnetic body; use initial magnetic permeability 100

(3)-2 New Structure Multi-Layer Transformer 30
Primary winding: five turns/layer three layers: fifteen turns
Secondary winding: five turns/layer six layers: thirty turns
Magnetic body; use initial magnetic permeability 500

Further, the results of the electrical characteristic value of (1) to (3)-2 above are as shown in Table 1 below.

TABLE 1

| | Electrical Characteristic values | | | | |
|---|---|---|---|---|---|
| STRUCTURE | Lp(μH) | Ls(μH) | Ip(μH) | Is(μH) | K |
| (1) | 4.25 | 8.31 | 1.48 | 3.02 | 0.807 |
| (2)-1 | 6.06 | 12.7 | 0.24 | 0.51 | 0.980 |
| (2)-2 | 28.2 | 55.1 | 0.34 | 0.72 | 0.994 |
| (3)-1 | 53.5 | 102.2 | 1.28 | 2.62 | 0.988 |
| (3)-2 | 258.1 | 515.3 | 1.03 | 2.15 | 0.998 |

*Voltage proof between primary and secondary windings is (1) 3 KV or less, (2) 8 to 10 KV, (3) 8 to 10 KV, respectively.

INDUSTRIAL APPLICABILITY

The fabrication method of the multi-layer magnetic part of the present invention is able to create composite sheets, magnetic sheets, and primary and secondary windings by using sheet-molding technology and film thickness formation technology and makes it possible to mass-produce the multi-layer magnetic part according to the present invention accurately and inexpensively.

The invention claimed is:

1. A multi-layer magnetic part, comprising:

a composite sheet which is constituted by a central magnetic pattern that is formed by drying a magnetic body paste applied to a substrate and peeling the dried magnetic body paste from the substrate, a dielectric pattern that is formed so as to surround said central magnetic pattern by drying a nonmagnetic body paste applied to said substrate and peeling the dried nonmagnetic body paste from the substrate, and a peripheral magnetic pattern that is formed so as to surround said dielectric pattern by drying a magnetic body paste applied to said substrate and peeling the dried magnetic body paste from the substrate;

a primary winding or secondary winding, or both such primary and secondary windings, provided on one face of the dielectric pattern and around the center;

a primary winding or secondary winding, or both such primary and secondary windings, provided on the other face of the dielectric pattern and around the center; and a pair of magnetic sheets which are obtained by applying a magnetic body paste to a substrate and drying the paste and which hold the composite sheet and the primary and secondary windings from both sides and contact one another via the magnetic pattern.

2. The multi-layer magnetic part according to claim 1, wherein the composite sheet the center and periphery of which are a magnetic pattern and a part of which except the is inserted between the magnetic sheet and the primary or secondary winding.

3. The multi-layer magnetic part according to claim 1, wherein the composite sheet is stacked in a plurality of layers; and through-holes connecting respectively a plurality of primary windings and a plurality of secondary windings located with the dielectric pattern of the composite sheets interposed therebetween are provided in the composite sheets.

4. The multi-layer magnetic part according to claim 1, wherein the film thickness of the magnetic pattern and the film thickness of the dielectric pattern of the composite sheet are equal.

5. A method of fabricating the multi-layer magnetic part according to any of claims 1 to 4, comprising the steps of:

creating the magnetic sheet by applying a magnetic body paste to a substrate and drying the paste;

creating the composite sheet separately by applying a nonmagnetic body paste to a substrate in the form of the dielectric pattern and applying a magnetic body paste to the substrate in the form of the magnetic pattern and drying the pastes;

creating the primary and secondary windings by applying a conductor paste to the composite sheet or the magnetic sheet and drying the paste; and peeling the magnetic sheet and the composite sheet thus obtained from the substrate and stacking the magnetic sheet and composite sheet and pressurizing same to produce a stacked body, and firing the stacked body.

6. A multi-layer magnetic part, comprising:

a composite sheet which is constituted by a central magnetic pattern, a dielectric pattern that is formed so as to surround said central magnetic pattern, and a peripheral magnetic pattern that is formed so as to surround said dielectric pattern;

a primary winding or secondary winding, or both such primary and secondary windings, are provided on one face of the dielectric pattern and around the center magnetic pattern;

a primary winding or secondary winding, or both such primary and secondary windings, are provided on the other face of the dielectric pattern and around the center magnetic pattern; and a pair of magnetic sheets are formed to sandwich said composite sheet, and to contact each other via said central magnetic pattern and said peripheral magnetic pattern, wherein the composite sheet only has through holes to provide an electrical connection with one or more of the primary and secondary windings.

7. The multi-layer magnetic part of claim 6 wherein the peripheral magnetic pattern has a rectangular configuration to surround the dielectric pattern and primary and secondary windings as a result of contact with the pair of magnetic sheets.

8. The multi-layer magnetic part of claim 6 wherein the composite sheet has a thickness of 50 μm.

9. The multi-layer magnetic part of claim 8 wherein the pair of magnetic sheets have respective thicknesses of 100 μm.

10. A multi-layer laminated transformer unit of a compact configuration comprising:

a plurality of composite sheets having a magnetic pattern and a dielectric pattern of equal film thicknesses on each composite sheet including a center magnetic pattern and a peripheral magnetic pattern that extends about the entire periphery of the dielectric pattern, the dielectric pattern surrounds the center magnetic pattern and separates the center magnetic pattern from the peripheral magnetic pattern, the plurality of composite sheets have a flat continuous surface;

a primary winding pattern;

a secondary winding pattern, wherein composite sheets adjacent the primary winding pattern and adjacent the secondary winding pattern only have through-holes to interrupt the flat continuous surface of the adjacent composite sheets to permit electrical connection to the primary winding pattern and the secondary winding pattern; and a pair of magnetic sheets, one on a top of the plurality of composite sheets and one on a bottom of the plurality of composite sheets are pressed and adhered to the plurality of composite sheets to form the multi-layer laminated transformer unit wherein the center magnetic patterns form a transformer core in magnetic contact with the pair of magnetic sheets and the peripheral magnetic patterns form an outer magnetic path in contact with the pair of magnetic sheets to provide an improved magnetic coupling coefficient.

11. The multi-layer laminated transformer unit of claim 10 wherein the pair of magnetic sheets have thicknesses equal to the composite sheets.

12. The multi-layer laminated transformer unit of claim 10 wherein the center magnetic pattern is circular and the peripheral magnetic pattern is rectangular.

13. The multi-layer laminated transformer unit of claim 10 wherein each of the plurality of composite sheets have a thickness of 50 μm.

14. The multi-layer laminated transformer unit of claim 13 wherein each of the pair of magnetic sheets have respective thicknesses of 100 μm.

* * * * *